US006400185B2

(12) United States Patent
Pavan

(10) Patent No.: US 6,400,185 B2
(45) Date of Patent: Jun. 4, 2002

(54) FIXED TRANSCONDUCTANCE BIAS APPARATUS

(75) Inventor: Shanthi Pavan, Piscataway, NJ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/789,219

(22) Filed: Feb. 20, 2001

Related U.S. Application Data

(60) Provisional application No. 60/187,554, filed on Mar. 7, 2000.

(51) Int. Cl.[7] ..... G05F 1/10

(52) U.S. Cl. ..... 327/54.3; 327/538; 323/315

(58) Field of Search ..... 327/538, 540, 327/541, 543; 323/315; 330/253, 257, 258, 261

(56) References Cited

U.S. PATENT DOCUMENTS 5,602,509 A * 2/1997 Kimura ..... 330/253

* cited by examiner

*Primary Examiner*—Terry D. Cunningham

(74) *Attorney, Agent, or Firm*—Alan K. Stewart; Wade James Brady, III; Frederick J. Telecky, Jr.

(57) ABSTRACT

A transconductance bias circuit includes: a differential pair having a first transistor M14 and a second transistor M15; a resistor R coupled between a gate of the first transistor M14 and a gate of the second transistor M15, the gate of the first transistor M14 is coupled to a reference voltage node; a third transistor M10 coupled to the first transistor M14; a fourth transistor M11 coupled to the second transistor M15; a fifth transistor M8 coupled to the third transistor M10, a gate of the fifth transistor M8 is coupled to the reference voltage node; a sixth transistor M9 coupled to the fourth transistor M11, a gate of the sixth transistor M9 is coupled to the reference voltage node; a current mirror 22 coupled to the fifth and sixth transistors M8 and M9; and a seventh transistor M6 coupled to the fourth transistor M11, a current in the seventh transistor M6 is equal to a current in the resistor R.

7 Claims, 1 Drawing Sheet

FIXED TRANSCONDUCTANCE BIAS APPARATUS

This application claims priority under 35 USC 119(e) (1) of provisional application No. 60/187,554, filed Mar. 7, 2000.

FIELD OF THE INVENTION

This invention generally relates to electronic systems and in particular it relates to fixed transconductance bias circuits.

BACKGROUND OF THE INVENTION

Many techniques can be used for a fixed transconductance bias circuit, but for the simplest implementations, it is common to slave the transconductance of the desired MOSFET to a precise off chip resistor. One of the prior art techniques that has been used is shown in FIG. 1. The following model (Eq. 1) is assumed for a MOS transistor operating in strong inversion and saturation.

$$I_{DS} = \frac{\mu_n C'_{ox}}{2\alpha}\left(\frac{W}{L}\right)(V_{GS} - V_T)^2 \quad \text{Eq. 1}$$

where all the symbols have their usual meanings which are well known in the art. Velocity saturation effects and finite drain conductance are also neglected. The current mirror formed by transistors M3 and M4 forces identical currents through transistors M1 and M2.

$$I_{M1} = \frac{\mu_n C'_{ox}}{2\alpha}\left(\frac{W}{L}\right)(V_{GS1} - V_T)^2 \quad \text{Eq. 2}$$

$$I_{M2} = \frac{\mu_n C'_{ox}}{2\alpha}\left(\frac{4W}{L}\right)(V_{GS2} - V_T)^2 \quad \text{Eq. 3}$$

$$I_{M1}=I_{M2}=I \quad \text{Eq. 4}$$

$$V_{GS1}-V_{GS2}=IR \quad \text{Eq. 5}$$

From Eq. 2, Eq. 3 and Eq. 4, $$V_{GS1}-V_T=2(V_{GS2}-V_T) \quad \text{Eq. 6}$$

From Eq. 5 and Eq. 6, $$V_{GS1}-V_T=2IR \quad \text{Eq. 7}$$

and the transconductance of transistor M1 is given by Eq.8, $$g_m|M1 = \left(\frac{2I}{V_{GS1} - V_T}\right) = \frac{1}{R} \quad \text{Eq. 8}$$

The circuit thus stabilizes to a state where the current is such that the transconductance ($g_m$) of M1 is maintained at 1/R, if irrespective of $V_T$, $\mu$, or temperature. This current can be used to bias other MOSFETs.

The prior art circuit of FIG. 1 has the following problems. In n-well technologies, the body terminal of n-channel devices is constrained to be grounded. There will be an error in the set transconductance because transistors M1 and M2 do not have the same threshold voltages any more. Another problem, which arises when this circuit is used with short channel transistors, is that the MOSFET is no longer a square law device, and this causes significant error.

There is sensitivity to the output conductances of transistors M1 and M2. In fine line CMOS, the devices have high output conductances in saturation. Since the drain-source voltages of transistors M1 and M2 are different, an error is introduced. There is also sensitivity to supply voltage. As the value of the power supply voltage changes, the drain-source voltages of transistors M1 and M2 change differently, causing significant dependence of the set $g_m$ value on the power supply voltage.

An improvement on the circuit of FIG. 1 is the prior art circuit shown in FIG. 2. This is described in Eq. 2. This is equivalent to the arrangement of FIG. 1, except that the sources of transistors M1 and M2 are at the same potential (ground). Hence their thresholds are the same, and error due to different thresholds is eliminated. The problems with the prior art circuit of FIG. 2 are as follows. In n-well technologies, the body terminal of n-channel devices is constrained to be grounded. Thus, this circuit can only be used to set the $g_m$ of grounded-source MOSFETs. This is a serious limitation. Another problem, which arises when the circuit of FIG. 2 is used with short channel transistors, is that the MOSFET is no longer a square law device, and this causes significant error.

There is sensitivity to the output conductances of transistors M1 and M2 in FIG. 2. In fine line CMOS, the devices have high output conductances in saturation. Since the drain-source voltages of transistors M1 and M2 are different, an error is introduced. Moreover, transistor M1 can operate in the triode region if its threshold voltage is low. Thus, this arrangement can only be used for enhancement devices, or such $g_m$ values where transistor M1 is not pushed into triode. There is also sensitivity to supply voltage. As the value of the power supply voltage changes, the drain-source voltages of transistors M1 and M2 change differently, causing significant dependence of the set $g_m$ value on the power supply voltage.

SUMMARY OF THE INVENTION

Generally, and in one form of the invention, the transconductance bias circuit includes: a differential pair having a first transistor and a second transistor; a resistor coupled between a gate of the first transistor and a gate of the second transistor, the gate of the first transistor is coupled to a reference voltage node; a third transistor coupled to the first transistor; a fourth transistor coupled to the second transistor; a fifth transistor coupled to the third transistor, a gate of the fifth transistor is coupled to the reference voltage node; a sixth transistor coupled to the fourth transistor, a gate of the sixth transistor is coupled to the reference voltage node; a current mirror coupled to the fifth and sixth transistor; and a seventh transistor coupled to the fourth transistor, a current in the seventh transistor is equal to a current in the resistor.

DETAILED DESCRIPTION OF PREFERRED EMBODIMENTS

Figure 1:
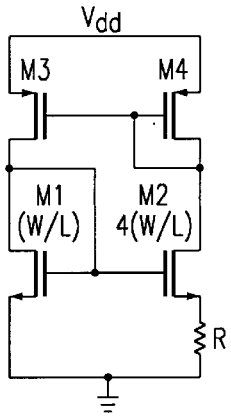
FIG. 1 (PRIOR ART)
FIG. 1 is a schematic circuit diagram of a first prior art fixed transconductance bias circuit.
Figure 2:
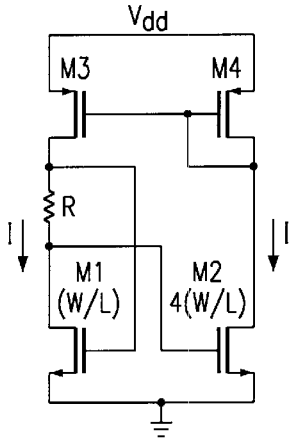
FIG. 2 (PRIOR ART)
FIG. 2 is a schematic circuit diagram of a second prior art fixed trandconductance bias circuit.
Figure 3:
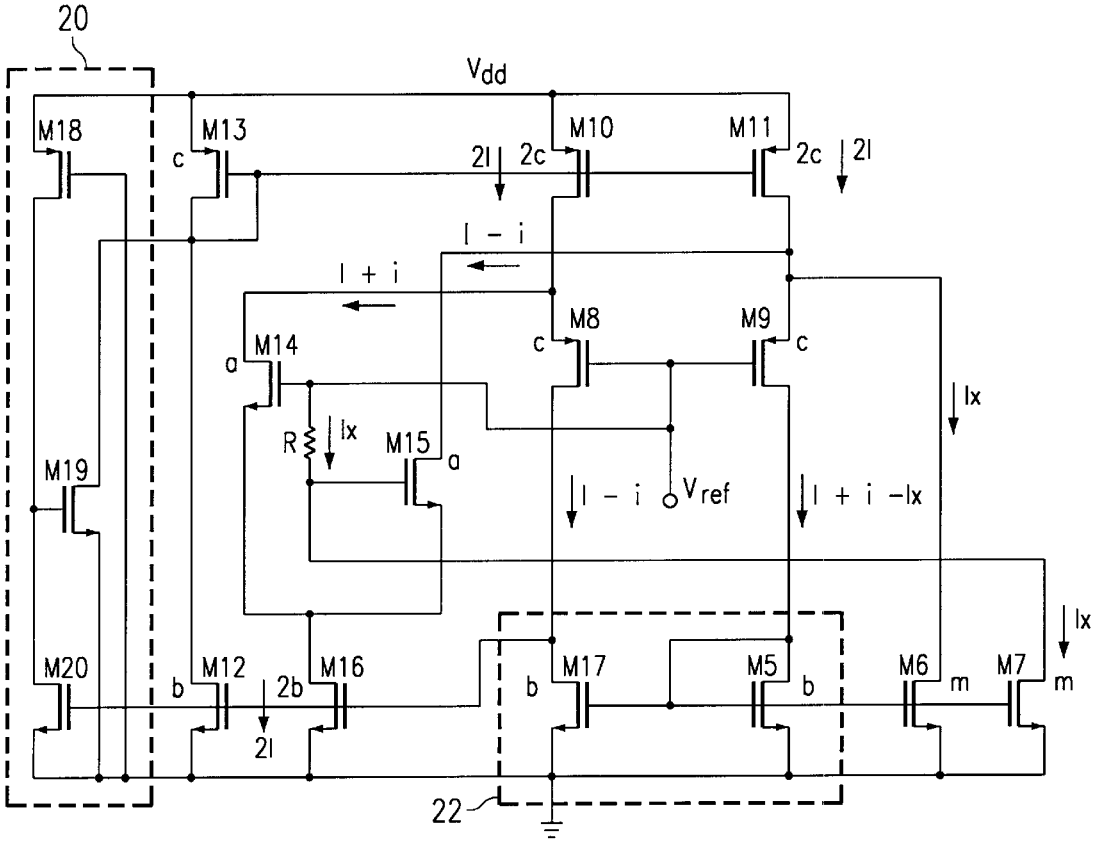
FIG. 3 is a schematic circuit diagram of a preferred embodiment fixed transconductance bias circuit.

In many CMOS analog circuits, (like amplifiers and filters), it is necessary to keep the transconductance ($g_m$) of a MOSFET constant over process and temperature. The preferred embodiment circuit of FIG. 3 provides a technique for setting the transconductance of a MOSFET to a precise conductance. This technique works even for very short channel devices when the MOSFET no longer obeys the square law. It is remarkably tolerant to low output conductances of fine line CMOS transistors.

First, what is needed for a good "fixed-$g_m$" bias circuit is summarized. The circuit should not depend on the square law behavior of the MOSFET. There should not be any constraint on the absolute gate voltage—in other words, the circuit should be able to set the gate of the MOSFET independently, and derive an appropriate source voltage (or drain current) such that the transconductance ($g_m$) of the device equals 1/R. The circuit should be independent of the value of the power supply voltage. The circuit should be as insensitive as possible to the output conductances of the transistors.

The preferred embodiment fixed transconductance bias circuit, shown in FIG. 3, includes NMOS transistors M5, M6, M7, M12, M14, M15, M16, and M17; PMOS transistors M8, M9, M10, M11, and M13; resistor R; start-up circuit 20 which includes PMOS transistor M18 and NMOS transistors M19 and M20; reference voltage Vref; and source voltage Vdd. The aspect ratios (W/L) of the transistors in FIG. 3 are denoted by lower case letters next to the devices (like a, b, c, m, etc.). Transistors M14 and M15 form a differential pair. Transistors M5 and M17 form current mirror 22.

The differential voltage input is $\Delta v = I_x R$. This causes current (I+i) to flow through transistor M14 and current (I−i) to flow through transistor M15, where 2I is the tail current of the differential pair. The current through transistor M8 is (I−i), and that through transistor M9 is ($I+i-I_x$). This must be equal to the current flowing in transistor M8. Thus, $$I-i=I+i-I_x \qquad \text{Eq. 9}$$

or $$I_x=2i \qquad \text{Eq. 10}$$

For the differential pair formed by transistors M1 and M2, the following equation is derived:

$$i = g_m\left(\frac{RI_x}{2}\right) \qquad \text{Eq. 11}$$

where $g_m$ is the transconductance of transistor M1. Since $I_x=2i$, the transconductance is given by $g_m=1/R$. Thus, the tail current through transistor M16 can be replicated and used to bias other MOSFETs on the chip, which have their gate voltages fixed at $V_{ref}$.

The advantages of the preferred embodiment circuit of FIG. 3 are the following. The circuit works well independent of the exact $I_d$–$V_{gs}$ behavior of the MOSFET—i.e., it works even when channel lengths are small, and oxides are thin (in the presence of mobility reduction and velocity saturation). The circuit is relatively insensitive to power supply voltage, because transistors M14 and M15 have their drain potentials determined by $V_{ref}$, and not referred to the supply voltage. The circuit is remarkably tolerant of low output resistances of the transistors. To see that this is so, consider the following. In steady state, since $I_x=2i$, the currents through transistors M8 and M9 are identical. Hence, their source potentials will be equal. This means that transistors M14–M15 and transistors M10–M11 have the same $V_{DS}$. Hence, there is no $\Delta V_{DS}$ induced offset current in these device pairs. Transistors M17 and M5 also carry the same current, and have almost the same $V_{DS}$. This means that they form a perfect mirror. Transistors M8 and M9 have the same $V_{DS}$ too. Thus, all systematic error in the loop is avoided.

Simulations on this circuit show that the transconductance $g_m$ of transistor M14 tracks 1/R with less than 0.25% error over a hundred degrees centigrade.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A transconductance bias circuit comprising:

a differential pair having a first transistor and a second transistor;

a resistor coupled between a gate of the first transistor and a gate of the second transistor, the gate of the first transistor is coupled to a reference voltage node;

a third transistor coupled to the first transistor; and having a gate coupled to the gate of the third transistors a fourth transistor coupled to the second transistor the gates of the third and fourth transistors being coupled to a control voltage;

a fifth transistor coupled to the third transistor, a gate of the fifth transistor is coupled to the reference voltage node;

a sixth transistor coupled to the fourth transistor, a gate of the sixth transistor is coupled to the reference voltage node; and a current mirror coupled to the fifth and sixth transistor and resistor and having, and a seventh transistor coupled to the fourth transistor, a current in the seventh transistor is equal to a current in the resistor.

2. The circuit of claim 1 wherein the current mirror further comprises an eighth transistor coupled to the first transistor and the second transistor.

3. The circuit of claim 2 wherein the current mirror further comprises a ninth transistor coupled to the resistor and having a gate coupled to a gate of the seventh transistor.

4. The circuit of claim 3 further comprising a tenth transistor coupled to a gate of the third transistor and an eleventh transistor coupled to the tenth transistor and having a gate coupled to a gate of the eighth transistor.

5. The circuit, of claim 4 further comprising a start-up circuit coupled the tenth transistor providing the control voltage.

6. The circuit of claim 1 wherein the current mirror further comprises:

an eighth transistor coupled to the fifth transistor; and a ninth transistor coupled to the sixth transistor, a gate of the ninth transistor is coupled to a gate of the eighth transistor.

7. The circuit of claim 6 wherein the gate of the seventh transistor is coupled to the gate of the ninth transistor.

* * * * *